US009366122B2

(12) United States Patent
Anderson et al.

(10) Patent No.: US 9,366,122 B2
(45) Date of Patent: Jun. 14, 2016

(54) NATURAL FRACTURE INJECTION TEST

(75) Inventors: Christopher R L Anderson, Sugar Land, TX (US); Daniel Moos, Palo Alto, CA (US); Colleen A. Barton, Portola Vly, CA (US)

(73) Assignee: BAKER HUGHES INCORPORATED, Houston, TX (US)

( * ) Notice: Subject to any disclaimer, the term of this patent is extended or adjusted under 35 U.S.C. 154(b) by 907 days.

(21) Appl. No.: 13/591,745

(22) Filed: Aug. 22, 2012

(65) Prior Publication Data

US 2014/0058686 A1 Feb. 27, 2014

(51) Int. Cl.

| | |
|---|---|
| ***G01M 3/04*** | (2006.01) |
| ***E21B 43/26*** | (2006.01) |
| ***E21B 47/06*** | (2012.01) |
| ***E21B 49/00*** | (2006.01) |
| *E21B 49/08* | (2006.01) |

(52) U.S. Cl.

CPC ..... *E21B 43/26* (2013.01); *E21B 47/06* (2013.01); *E21B 49/008* (2013.01); *E21B 49/08* (2013.01)

(58) Field of Classification Search

CPC ..... E21B 43/26; E21B 47/06; E21B 49/008; E21B 49/08

USPC ..... 702/51

See application file for complete search history.

(56) References Cited

U.S. PATENT DOCUMENTS

| | | | | |
|---|---|---|---|---|
| 3,636,762 | A | 1/1972 | Kuo et al. | |
| 4,378,845 | A * | 4/1983 | Medlin et al. | 166/297 |
| 5,163,321 | A * | 11/1992 | Perales | 73/152.52 |
| 6,378,363 | B1 | 4/2002 | Hache et al. | |
| 2005/0067162 | A1 * | 3/2005 | Gjedrem | 166/277 |
| 2005/0216198 | A1 | 9/2005 | Craig | |
| 2009/0272534 | A1 * | 11/2009 | Huang et al. | 166/279 |
| 2010/0286918 | A1 * | 11/2010 | Moos et al. | 702/12 |

FOREIGN PATENT DOCUMENTS

CA 1202882 A1 * 8/1986

OTHER PUBLICATIONS

Moos, Daniel "Improving Shale Gas Production Using Geomechanics", Improving Shale gas production Using Geomechanics, Touch Briefings 2011, Exploration & Production—vol. 8 Issue 2. pp. 2-5.

* cited by examiner

*Primary Examiner* — Toan Le

*Assistant Examiner* — Eyob Hagos

(74) *Attorney, Agent, or Firm* — Cantor Colburn LLP

(57) ABSTRACT

A method for estimating a property of an earth formation penetrated by a borehole includes: performing a borehole integrity test at a pressure less than a fracture gradient pressure of the formation to provide leakage data; injecting a fluid into the formation at a first pressure greater than the fracture gradient pressure during a first injection time interval using a fluid injector; measuring pressure versus time using a pressure sensor and a timer during a first test time interval to provide first pressure data; injecting a fluid into the formation at a second flow rate greater than the first flow rate during a second injection time interval using the fluid injector; measuring pressure versus time using the pressure sensor and the timer during a second test time interval to provide second pressure data; and estimating the property using the first pressure data, the second pressure data, and the leakage data.

14 Claims, 4 Drawing Sheets

NATURAL FRACTURE INJECTION TEST

BACKGROUND

Hydraulic stimulation is used to improve productivity of hydrocarbon formations. Hydraulic stimulation involves injecting a fluid into a geologic formation at a high enough pressure to open naturally occurring rock fractures to improve formation permeability. Performing hydraulic stimulation requires knowing the pressure to be applied to the fluid. In addition, an amount of expected increase in permeability is also required in order to determine if pursuing production will be cost effective.

In order to obtain this information, a conventional pressure test is typically performed. This test involves applying a pressurized fluid to the formation of interest at an initial pressure and recording the pressure decay over time, which can take a week or longer. In nano-Darcy shale, the time can be on the order of months for only a slight pressure decay. In addition, temperature fluctuations over that time can corrupt the recorded data degrading its value. Hence, it would be appreciated in the hydrocarbon production industry if methods and apparatus could be developed to decrease the time of formation pressure tests.

BRIEF SUMMARY

Disclosed is a method for estimating a property of an earth formation penetrated by a borehole. The method includes: performing a borehole integrity test at a pressure less than a fracture gradient pressure of the formation, the borehole integrity test providing leakage data; injecting a fluid into the formation at a first pressure greater than the fracture gradient pressure at a first flow rate during a first injection time interval using a fluid injector; measuring pressure versus time using a pressure sensor and a timer during a first test time interval after the injecting for the first injection time interval to provide first pressure data; injecting a fluid into the formation at a second flow rate greater than the first flow rate during a second injection time interval using the fluid injector; measuring pressure versus time using the pressure sensor and the timer during a second test time interval after the injecting for the second injection time interval to provide second pressure data; and estimating the property using the first pressure data, the second pressure data, and the leakage data.

Also disclosed is an apparatus for estimating a property of an earth formation penetrated by a borehole. The apparatus includes: a fluid injector configured to inject fluid through the borehole into the formation at a selected flow rate; a pressure sensor configured to sense pressure of a fluid in the borehole; a timer configured to measure a time interval; and a processor. The processor is configured to: receive leakage data from a borehole integrity test conducted at a pressure less than a fracture gradient pressure of the formation using the fluid injector; receive first pressure data having a pressure versus time measurement obtained using the pressure sensor and the timer during a first test time interval after injecting a fluid into the formation at a first pressure greater than the fracture gradient pressure at a first flow rate during a first injection time interval using the fluid injector; receive second pressure data having a pressure versus time measurement obtained using the pressure sensor and the timer during a second test time interval after injecting a fluid into the formation at a second flow rate greater than the first flow rate during a second injection time interval using the fluid injector; and estimate the property using the first pressure data, the second pressure data, and the leakage data.

Further disclosed is a non-transitory computer-readable medium having computer-executable instructions for estimating a property of an earth formation penetrated by a borehole by implementing a method that includes: receiving leakage data from a borehole integrity test conducted at a pressure less than a fracture gradient pressure of the formation using a fluid injector; receiving first pressure data having a pressure versus time measurement obtained using a pressure sensor and a timer during a first test time interval after injecting a fluid into the formation at a first pressure greater than the fracture gradient pressure at a first flow rate during a first injection time interval using the fluid injector; receiving second pressure data having a pressure versus time measurement obtained using the pressure sensor and the timer during a second test time interval after injecting a fluid into the formation at a second flow rate greater than the first flow rate during a second injection time interval using the fluid injector; and estimating the property using the first pressure data, the second pressure data, and the leakage data.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the Figures.

Disclosed are a method and apparatus for testing a formation of interest intended for hydraulic stimulation. Results from testing may be used to select a hydraulic stimulation pressure and a formation permeability or injectivity that results from hydraulic stimulation at the selected pressure.

Figure 1:
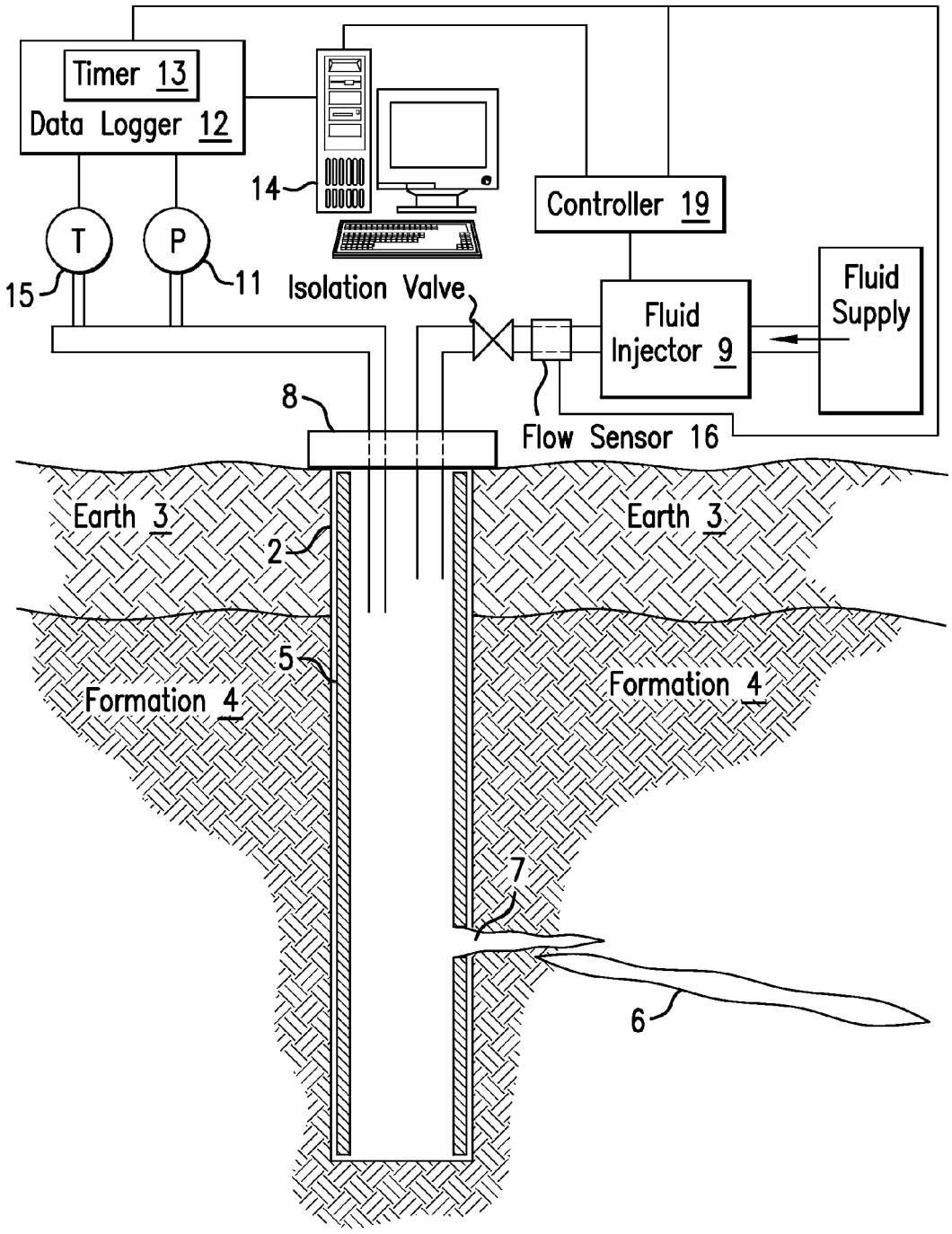
FIG. 1 illustrates an exemplary embodiment of a borehole penetrating an earth formation.

Reference may now be had to FIG. 1. FIG. 1 illustrates a cross-sectional view of an exemplary embodiment of a borehole 2 penetrating the earth 3, which includes an earth formation 4. The borehole 2 is lined with a casing 5. In other embodiments, the borehole 2 may be open or partially lined with the casing 5. The formation 4 includes a fracture 6. The fracture 6 has a vertical displacement having a wing that extends radially from the borehole 2. It can be appreciated that the formation 4 may include a plurality of fractures having different shapes and orientations depending on the type and strength of rock in the formation 4 and the stresses imposed on the rock.

A perforating gun (not shown) may be used to perforate the casing 5 to provide a perforation 7 and access to the formation 4. In general, the perforating gun has sufficient power to achieve a uniform and long perforation tunnel into the formation 4 to provide adequate fluid communication with the formation 4 and to ensure clearing of casing and cementing material to prevent blockage of the tunnel.

A borehole cap 8 is used to seal the borehole 2 from an external environment at the surface of the earth 3 thereby confining an applied pressure to the borehole 2 and to the formation 4 via the perforation 7. A fluid injector 9 is in fluid communication with the borehole 2 and, thus, the formation 4 via the perforation 7. The fluid injector 9 is configured to inject a fluid (liquid, gas or gel) into the borehole 2 and the formation 4 at a selected constant flow rate. In one or more embodiments, the fluid injector 9 is a pump such as a positive displacement pump. However, other types of pumps or injection devices may also be used. A controller 19 is coupled to the fluid injector 9 and used to select the constant flow rate and regulate the fluid injector 9 to provide that rate. In general, the fluid injector 9 can provide sufficient output pressure to achieve the desired constant flow rate. It can be appreciated that the injection of fluid may also be performed at a variable flow rate in one or more embodiments.

A pressure sensor 11 is in fluid communication with the borehole 2 and the formation 4 via the perforation 7. The pressure sensor 11 is configured to sense pressure of the formation 4. The pressure sensor 11 may disposed at the surface of the earth 3 and its output corrected to account for the static pressure head between the surface of the earth 3 and depth of the formation 4 and "friction pressure." In another embodiment, the pressure sensor 11 may be disposed downhole closer to the formation 4 to provide a more direct measurement of the formation pressure. Output from the pressure sensor 11 is provided to a data logger 12, which is configured to record or log pressure measurements over time made by the pressure sensor 11. The data logger 12 includes a timer 13 for recording the time each measurement was made and thus providing a record of pressure versus time. A computer processing system 14 is coupled to the data logger 12 and is configured to receive data from the data logger 12. The computer processing system 12 is further configured to process the received data and provide desired output to a user. In an alternative embodiment, the computer processing system 14 may be configured to also perform the functions of the data logger 12 and the timer 13.

A temperature sensor 15 is in thermal communication with a fluid disposed in the borehole and provides borehole fluid temperature data to the data logger 12, which also records the time each temperature measurement was performed. The computer processing system 14 can then use this temperature data to correct formation pressure measurements for temperature variations using an equation of state for the borehole fluid.

A flow sensor 16 is configured to measure the fluid injection flow rate. The measured flow rate is input into the data logger 12, which records the time of each measurement. From the flow rate measurements and time, the total injection fluid volume may be determined. The measured flow rate is also input into the controller 19 to provide a feedback control loop for injecting at a constant flow rate when desired. Flow sensor data may be used to account for any flow variations that may occur when injecting at a constant flow rate. Alternatively, flow sensor data may be used to account for total injection volume when injecting at a variable injection flow rate.

The fluid injector 9, the controller 19, the pressure sensor 11, the temperature sensor 15, the flow sensor 16, the data logger 12 and the computer processing system 14 may be referred to as test apparatus and may include other components necessary for several types of disclosed testing.

One type of test is a formation buildup test, which measures formation pore pressure. The pore pressure is the pressure of fluids in pores of rock in the formation 4 and is generally due to the hydrostatic pressure from a column of fluid to the depth of the pores of interest where the pore pressure is being measured. The pore pressure may be interpreted as being a "background" pressure against which pressure measurements from formation injection tests are referenced or compared. In one or more embodiments, after the casing 5 is perforated, a plug (not shown) is set in the borehole 2 above the perforation 7 with the pressure sensor 11 being disposed to sense pressure below the plug. The sensed pressure builds up and settles to a value over a period of time. In one or more embodiments, the period of time is about 36 hours. The settled pressure provides an indication of the pore pressure. It can be appreciated that use of the plug provides a reduced volume for formation fluid to flow into and, thereby, decreases the time required to perform the formation buildup test.

Another test performed is a borehole integrity test. The borehole integrity test measures leakage from a sealed borehole 2 and provides leakage data. The user can use the leakage data to verify that borehole leakage is less than a threshold leakage point before proceeding with testing to characterize the formation 4. Alternatively, the leakage data can be used to correct subsequent formation pressure tests for borehole leakage.

In the borehole integrity test, any downhole plugs are removed and a fluid is injected using the fluid injector 9 into the borehole 2 and thus the formation 4 via the perforation 7. The fluid is injected below an estimated fracture gradient pressure of the formation 4. The term "fracture gradient pressure" relates to the pressure at which pre-existing rock fractures in the formation 4 will open and begin to accept fluid. In one or more embodiments, the fluid is injected at a low constant rate until a formation pressure below the estimated fracture gradient pressure is reached. The constant fluid injection flow rate is low enough such that the required pressure to inject at that rate does not exceed the fracture gradient pressure. In a non-limiting embodiment, the fluid injection rate is 0.3 barrels per minute (bpm) of fluid where each barrel contains 42 gallons. In one or more embodiments, the controller 19 trips the fluid injector 9 when the formation pressure is 80% of the estimated fracture gradient pressure. The fluid pressure and temperature either at the surface or downhole closer to the formation 4 are recorded with time by the data logger 12. The recorded temperature may be used to correct the pressure measurements for temperature variations using a known equation of state of the fluid. In addition to determining the integrity of the borehole 2, the borehole integrity test also provides information on connectivity of passages in the formation 4 and an indication of injectivity stimulation below the fracture gradient pressure. The term "injectivity" relates to the change in injection flow rate of fluid resulting from a corresponding change in fluid injection pressure (i.e., injection flow rate/injection pressure). The borehole integrity test is generally performed a minimum of two times unless injectivity stimulation is apparent. The borehole integrity test may also be repeated at higher injection rates.

Figure 2:
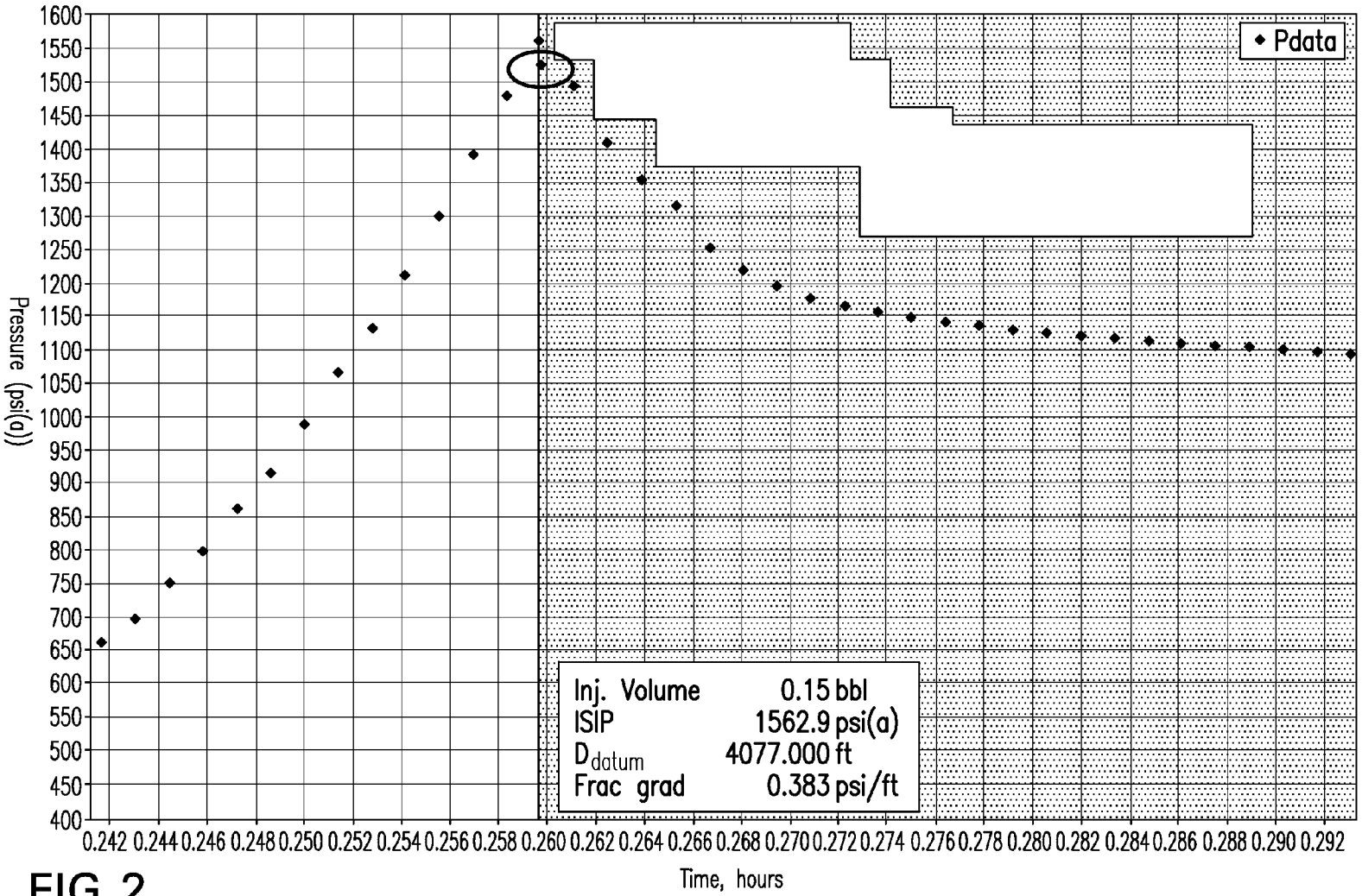
FIG. 2 is an exemplary graph of pressure versus time resulting from a formation pressure test.

A series of fluid injection tests are performed at a pressure greater than the fracture gradient pressure in order to characterize the formation 4. In a first fluid injection test, fluid is injected into the borehole 2 and thus into the formation 4 by the fluid injector 9 at a first pressure above the fracture gradient pressure at a low constant flow rate (i.e., first flow rate). In one or more embodiments, the first flow rate is in a range of 0.1 to 0.5 bpm, such as 0.3 bpm for example. As the fluid is being injected, the pressure will increase until formation breakdown at which point the pressure will start to decrease. The term "formation breakdown" relates to the pre-existing rock fractures opening up or increasing in size to accept fluid. This phenomenon is illustrated in FIG. 2. The fluid injector 9 is quickly shutdown after formation breakdown is evident. In one or more embodiments, the fluid injector 9 is shutdown 10 to 15 seconds after formation breakdown. After the fluid injector 9 is shutdown, the borehole 2 is sealed-in (e.g., by closing the isolation valve shown in FIG. 1) and the pressure and temperature over time are recorded by the data logger 12 over a time interval such as overnight or twelve hours for example. The pressure and temperature may also be logged during the fluid injection phase.

Figure 3:
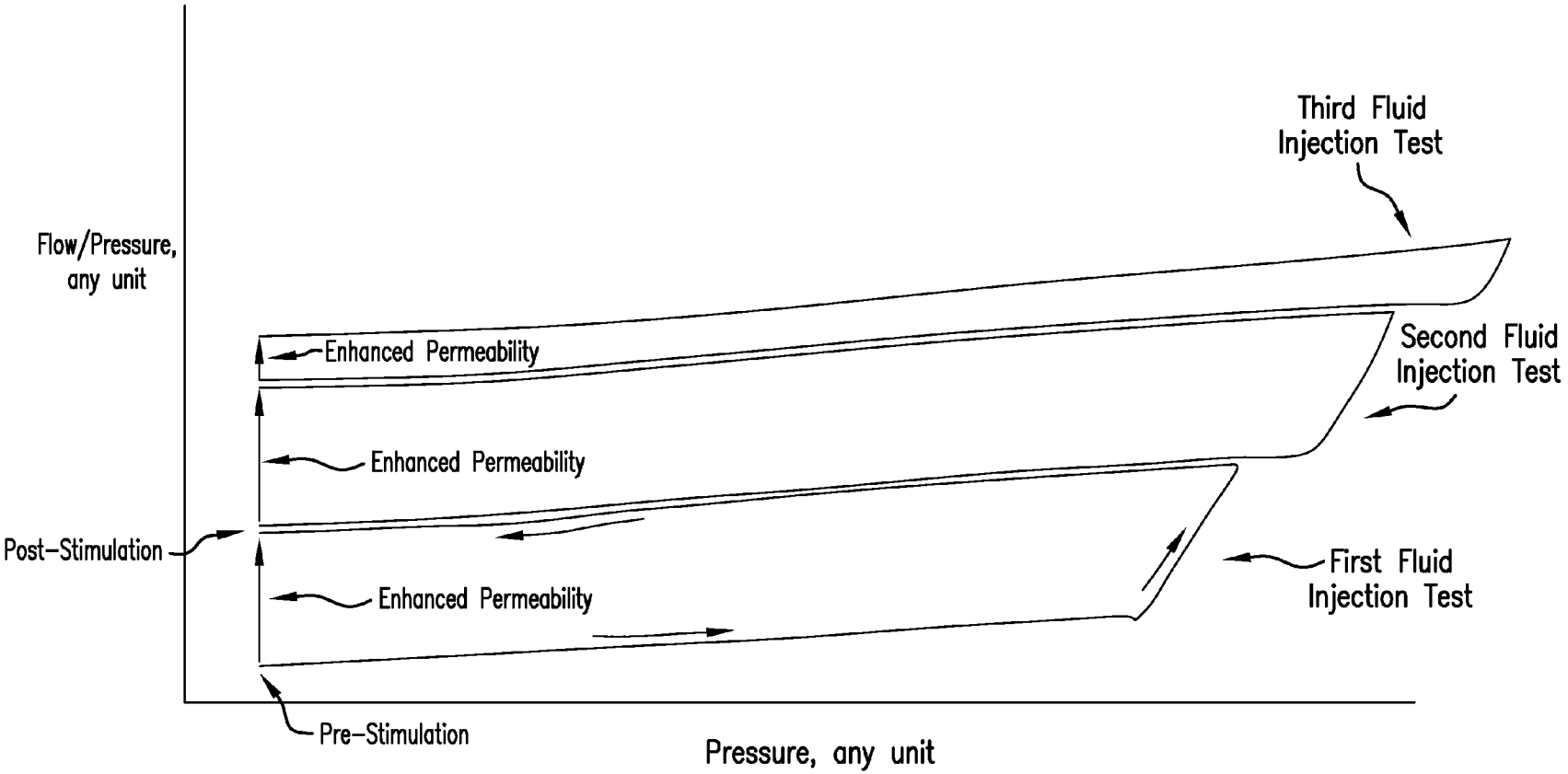
FIG. 3 is a graph of formation permeability versus pressure for a plurality of pressure tests at increasing fluid injection rates.

FIG. 3 illustrates diagrammatically how injectivity evolves during the first fluid injection test. A slow increase in injectivity will occur with increasing injection pressure until fractures begin to slip. Above that pressure, injectivity will increase rapidly (i.e., greater than the slow increase) as the number of fractures that are stimulated increases. When the injection or pumping pressure decreases, injectivity generally will decrease slowly, leaving behind a permanent increase in the injectivity. The physical concept is that critically stressed fractures will permanently slip to contribute to greater permeability when sufficient stimulation pressure is applied. The greater the stimulation pressure, the greater will be the population of critically stressed natural fractures.

In a second fluid injection test, fluid is injected into the borehole 2 at a second flow rate that is greater than the first flow rate. Accordingly, the fluid pressure (i.e., second pressure) during the second fluid injection test is greater than the first pressure. In one or more embodiments, the second flow rate is in a range of 0.6 to 2.0 bpm such as 1.0 bpm for example. As in the first fluid injection test, as the fluid is being injected, the pressure will increase until formation breakdown occurs again, but with a higher number permanently slipped fractures, at which point the pressure will start to decrease. The fluid injector 9 is quickly shutdown after the current formation breakdown is evident. In one or more embodiments, the fluid injector 9 is shutdown 10 to 15 seconds after formation breakdown. After the fluid injector 9 is shutdown, the borehole 2 is sealed-in and the pressure and temperature over time are recorded by the data logger 12 over a time interval such as overnight or twelve hours for example. The formation injectivity resulting from the second fluid injection test is illustrated in FIG. 3. The pressure and temperature may also be logged during the fluid injection phase.

In a third fluid injection test, fluid is injected into the borehole 2 at a third flow rate that is greater than the second flow rate. Accordingly, the fluid pressure (i.e., third pressure) during the third fluid injection test is greater than the second pressure. In one or more embodiments, the third flow rate is in a range 2.1 to 10 bpm such as 6.0 bpm for example. As in the first and second fluid injection tests, as the fluid is being injected, the pressure will increase until formation breakdown occurs again, but with a higher number permanently slipped fractures, at which point the pressure will start to decrease. The fluid injector 9 is quickly shutdown after the current formation breakdown is evident. In one or more embodiments, the fluid injector 9 is shutdown 10 to 15 seconds after formation breakdown. After the fluid injector 9 is shutdown, the borehole 2 is sealed-in and the pressure and temperature over time are recorded by the data logger 12 over a time interval such as overnight or twelve hours for example. The formation injectivity resulting from the third fluid injection test is illustrated in FIG. 3. The pressure and temperature may also be logged during the fluid injection phase.

The computer processing system 14 analyzes the recorded data from the fluid injections tests and identifies differences in the data between the different tests. For example, the differences in the injectivity curves for each of the fluid injection tests provide information to select a hydraulic fracture pressure for hydraulic fracturing for production purposes. If the increase in injectivity decreases after a certain point with increasing injection constant flow rates, then that is an indication that higher stimulation pressures may not be of benefit. Hence, in one or more embodiments, the hydraulic stimulation pressure is selected to be in a range above a point where the increase in injectivity starts to decrease with increasing injection flow rates.

It can be appreciated that the permeability of a fractured formation is a measure of the ease of fluid flow in the formation. Accordingly, measurements of injectivity may be related to or provide an indication of the permeability of the formation. In one or more embodiments, the ease of fluid flow relates to the pressure required for a certain amount of fluid to flow into the formation.

It can be appreciated that pressure measurements over time during and after fluid injection may be used to provide a measurement or indication of the length of fracture wings extending radially form the borehole because injected fluid will have a longer distance to travel to fill the fracture than if the fracture was closer to the borehole. Consequently, it would take a longer time to fill the fracture, which in one or more embodiments would be indicated by a longer time for pressure to build up.

Figure 4:
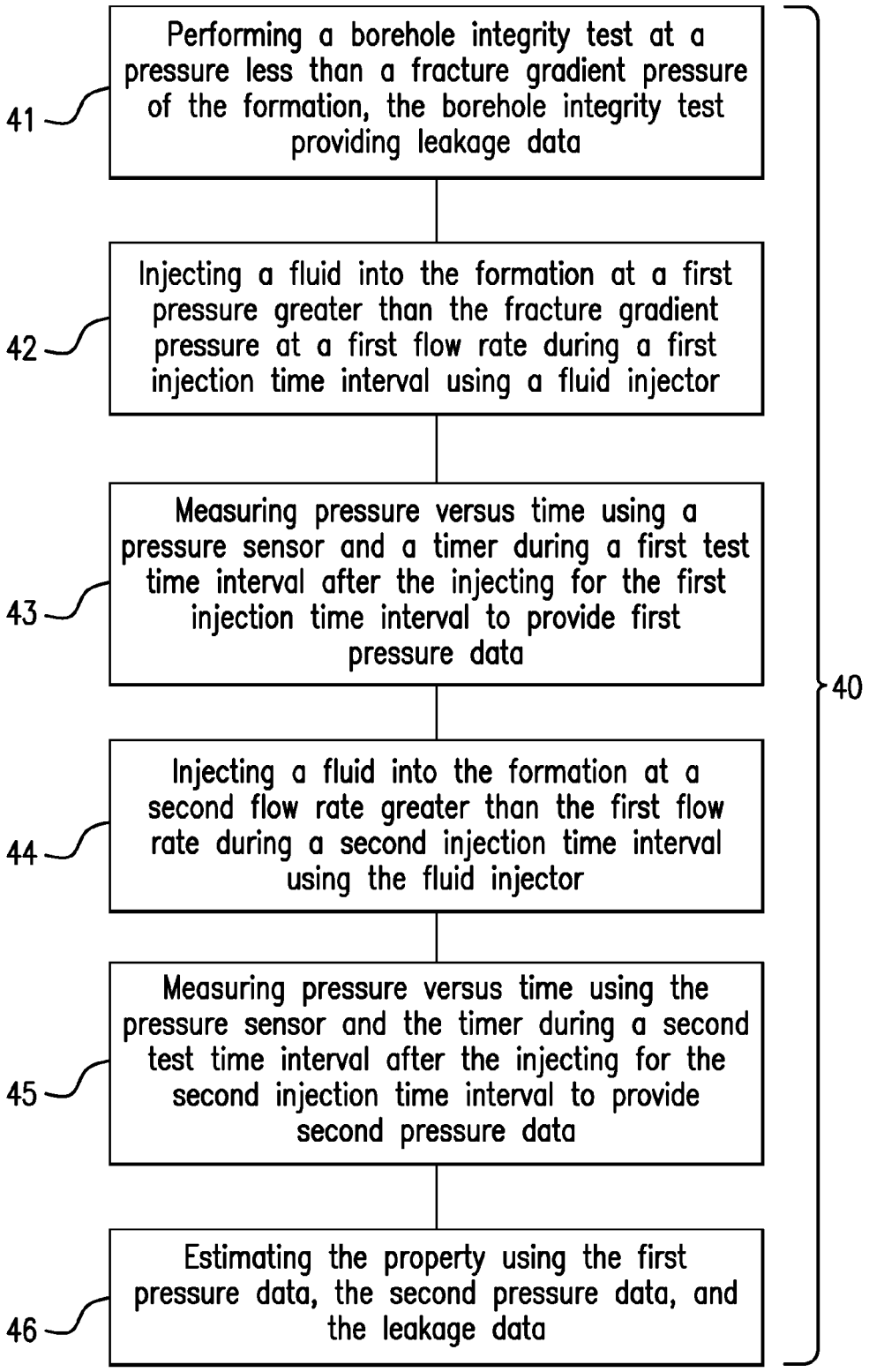
FIG. 4 is a flow chart for a method for estimating a property of a formation.

FIG. 4 is a flow diagram for a method 40 for estimating a property of an earth formation penetrated by a borehole. Block 41 calls for performing a borehole integrity test at a pressure less than a fracture gradient pressure of the formation where the borehole integrity test providing leakage data. Block 42 calls for injecting a fluid into the formation at a first pressure greater than the fracture gradient pressure at a first flow rate during a first injection time interval using a fluid injector. Block 43 calls for measuring pressure versus time using a pressure sensor and a timer during a first test time interval after the injecting for the first injection time interval to provide first pressure data. Block 44 calls for injecting a fluid into the formation at a second flow rate greater than the first flow rate during a second injection time interval using the fluid injector. Block 45 calls for measuring pressure versus time using the pressure sensor and the timer during a second test time interval after the injecting for the second injection time interval to provide second pressure data. Block 46 calls for estimating the property using the first pressure data, the second pressure data, and the leakage data. If leakage exists above a certain threshold, then the leakage data can be used to correct the first pressure data and the second pressure data. Further, the method 40 may include performing more fluid injection tests with each fluid injection test progressing to a higher injection flow rate. The data from these further fluid injection tests may be used to determine when injectivity starts to decrease with increasing pressure or flow rate. It can be appreciated that the more fluid injection tests are performed with smaller increments of increasing flow rate, the more accurate the formation property estimates may be. Further yet, the method 40 may include performing a fluid injection test with a decrease in a flow rate used in a previously performed injection test. In this case, the test data may be used to estimate the radial length of fractures based on the time dependency of the data.

In support of the teachings herein, various analysis components may be used, including a digital and/or an analog system. For example, pressure sensor 11, the temperature sensor 15, the flow sensor 16, the data logger 12, the timer 13, or the surface computer processing 14 may include the digital and/or analog system. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and "third" are used to distinguish elements and are not used to denote a particular order. The term "couple" relates to coupling a first component to a second component either directly or indirectly through an intermediate component.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for estimating a property of an earth formation penetrated by a borehole, the method comprising:

performing a borehole integrity test at a pressure less than a fracture gradient pressure of the formation wherein the fracture gradient pressure is a pressure at which pre-existing rock fractures in the earth formation will open and begin to accept fluid, the borehole integrity test providing leakage data, the borehole integrity test comprising injecting a fluid into the formation using a fluid injector at an integrity test flow rate that is low enough so that the fracture gradient pressure of the formation is not exceeded;

injecting a fluid into the formation at a first pressure greater than the fracture gradient pressure at a first flow rate during a first injection time interval using the fluid injector;

measuring pressure versus time using a pressure sensor and a timer during a first test time interval after the injecting for the first injection time interval to provide first pressure data;

injecting a fluid into the formation at a second flow rate greater than the first flow rate during a second injection time interval using the fluid injector;

measuring pressure versus time using the pressure sensor and the timer during a second test time interval after the injecting for the second injection time interval to provide second pressure data;

monitoring a fluid temperature in the borehole using a temperature sensor;

correcting the first pressure data and the second pressure data for fluid temperature variations using the monitored fluid temperature;

correcting the leakage data for fluid temperature variations using the monitored fluid temperature;

estimating the property using the corrected first pressure data, the corrected second pressure data, and the corrected leakage data using a processor;

estimating a hydraulic stimulation pressure to stimulate the formation using the corrected first pressure data, the corrected second pressure data, and the corrected leakage data; and hydraulically stimulating the earth formation using the estimated hydraulic stimulation pressure.

2. The method according to claim 1, wherein the property is permeability or injectivity.

3. The method according to claim 1, wherein at least one selection from a group consisting of the first injection time interval and the second injection time interval is twenty-four hours or less.

4. The method according to claim 1, wherein the first flow rate is less than one barrel per minute of the fluid injected during the first injection time interval and the first injection time interval is less than one minute.

5. The method according to claim 4, wherein the first flow rate is in a range of 0.1 to 0.5 barrels per minute and the first injection time interval is in a range of ten to fifteen seconds.

6. The method according to claim 5, wherein the second flow rate is in a range of one to two barrels per minute and the first injection time interval is in a range of ten to fifteen seconds.

7. The method according to claim 1, further comprising:

injecting a fluid into the formation at a third flow rate greater than the second flow rate during a third time interval using the fluid injector;

measuring pressure versus time using the pressure sensor and the timer during a third test time interval after the injecting for the third injection time interval to provide third pressure data using the pressure sensor; and estimating the property additionally using the third pressure data.

8. The method according to claim 7, wherein the third flow rate is greater than two barrels per minute of the fluid injected during the third injection time interval.

9. The method according to claim 8, wherein the third flow rate is in a range of five to seven barrels per minute.

10. The method according to claim 1, further comprising:

injecting a fluid into the formation at a fourth flow rate less than the second flow rate during a fourth time interval using the fluid injector;

measuring pressure versus time using the pressure sensor and the timer during a fourth test time interval after the injecting for the fourth injection time interval to provide fourth pressure data; and estimating the property additionally using the fourth pressure data.

11. An apparatus for estimating a property of an earth formation penetrated by a borehole, the apparatus comprising:

a fluid injector configured to inject fluid through the borehole into the formation at a selected flow rate;

a pressure sensor configured to sense pressure of a fluid in the borehole;

a timer configured to measure a time interval; and a temperature sensor configured to monitor a borehole fluid temperature; and a processor configured to:

receive leakage data from a borehole integrity test conducted at a pressure less than a fracture gradient pressure of the formation using the fluid injector wherein the fracture gradient pressure is a pressure at which pre-existing rock fractures in the earth formation will open and begin to accept fluid and the borehole integrity test comprises injecting a fluid into the formation using the fluid injector at an integrity test flow rate that is low enough so that the fracture gradient pressure of the formation is not exceeded;

receive first pressure data comprising a pressure versus time measurement obtained using the pressure sensor and the timer during a first test time interval after injecting a fluid into the formation at a first pressure greater than the fracture gradient pressure at a first flow rate during a first injection time interval using the fluid injector;

receive second pressure data comprising a pressure versus time measurement obtained using the pressure sensor and the timer during a second test time interval after injecting a fluid into the formation at a second flow rate greater than the first flow rate during a second injection time interval using the fluid injector; and correct the first pressure data and the second pressure data for fluid temperature variations using the monitored fluid temperature;

correct the leakage data for fluid temperature variations using the monitored fluid temperature;

estimate the property using the first corrected pressure data, the corrected second pressure data, and the corrected leakage data;

estimating a hydraulic stimulation pressure to stimulate the formation using the corrected first pressure data, the corrected second pressure data, and the corrected leakage data;

wherein a fluid injector for hydraulic stimulation is configured to inject a fluid into the earth formation at the estimated hydraulic stimulation pressure in order to hydraulically stimulate the earth formation.

12. The apparatus according to claim 11, wherein the processor is further configured to:

receive third pressure data comprising a pressure versus time measurement obtained using the pressure sensor and the timer during a third test time interval after injecting a fluid into the formation at a third flow rate greater than the second flow rate during a third time interval using the fluid injector; and estimate the property additionally using the third pressure data.

13. The apparatus according to claim 11, wherein the processor is further configured to:

receive fourth pressure data comprising a pressure versus time measurement obtained using the pressure sensor and the timer during a fourth test time interval after injecting a fluid into the formation at a fourth flow rate that is less than the second flow rate; and estimate the property additionally using the fourth pressure data.

14. A non-transitory computer-readable medium comprising computer-executable instructions for estimating a property of an earth formation penetrated by a borehole that when executed by a processor cause an apparatus to implement a method comprising:

receiving leakage data from a borehole integrity test conducted at a pressure less than a fracture gradient pressure of the formation using a fluid injector wherein the fracture gradient pressure is a pressure at which pre-existing rock fractures in the earth formation will open and begin to accept fluid, the borehole integrity test comprising injecting a fluid into the formation using a fluid injector at an integrity test flow rate that is low enough so that the fracture gradient pressure of the formation is not exceeded;

receiving first pressure data comprising a pressure versus time measurement obtained using a pressure sensor and a timer during a first test time interval after injecting a fluid into the formation at a first pressure greater than the fracture gradient pressure at a first flow rate during a first injection time interval using the fluid injector;

receiving second pressure data comprising a pressure versus time measurement obtained using the pressure sensor and the timer during a second test time interval after injecting a fluid into the formation at a second flow rate greater than the first flow rate during a second injection time interval using the fluid injector; and receiving a monitored fluid temperature in the borehole that was obtained using a temperature sensor;

correcting the first pressure data and the second pressure data for fluid temperature variations using the monitored fluid temperature;

correcting the leakage data for fluid temperature variations using the monitored fluid temperature;

estimating the property using the corrected first pressure data, the corrected second pressure data, and the corrected leakage data;

estimating a hydraulic stimulation pressure to stimulate the formation using the corrected first pressure data, the corrected second pressure data, and the corrected leakage data; and hydraulically stimulating the earth formation using the estimated hydraulic stimulation pressure.

* * * * *